United States Patent [19]

Pretchel et al.

[11] Patent Number: 4,776,803

[45] Date of Patent: Oct. 11, 1988

[54] INTEGRALLY MOLDED CARD EDGE CABLE TERMINATION ASSEMBLY, CONTACT, MACHINE AND METHOD

[75] Inventors: David A. Pretchel; John T. Venaleck, both of Madison, Ohio

[73] Assignee: Minnesota Mining and Manufacturing Company, St. Paul, Minn.

[21] Appl. No.: 935,238

[22] Filed: Nov. 26, 1986

[51] Int. Cl.[4] ..... H01R 9/09

[52] U.S. Cl. ..... 439/59; 249/97; 264/277; 425/517; 439/449; 439/494

[58] Field of Search ..... 264/277; 249/95, 97; 425/112, 123, 116, 517; 439/59, 449, 493, 494, 736

[56] References Cited

U.S. PATENT DOCUMENTS

| | | | |
|---|---|---|---|
| 2,701,867 | 5/1951 | Obenschain et al. | 439/606 |
| 3,137,537 | 6/1964 | Cole et al. | 439/493 |
| 3,241,096 | 11/1964 | Miller | 439/654 |
| 3,328,504 | 6/1967 | Hamel | 264/272.14 |
| 3,444,506 | 5/1969 | Wedekind | 439/405 |
| 3,673,548 | 6/1972 | Mattingly, Jr. et al. | 439/637 |
| 3,866,319 | 2/1975 | Steigerwald | 29/878 |
| 4,009,922 | 3/1977 | Aysta | 439/405 |
| 4,030,799 | 6/1977 | Venaleck | 439/405 |
| 4,288,139 | 9/1981 | Cobaugh et al. | 439/267 |
| 4,314,960 | 2/1982 | Hass | 264/277 X |
| 4,319,800 | 3/1982 | Bernat | 439/686 |
| 4,460,231 | 7/1984 | Muz | 439/491 |
| 4,596,428 | 6/1986 | Tengler | 439/95 |

FOREIGN PATENT DOCUMENTS 1380706 1/1975 United Kingdom .

*Primary Examiner*—Eugene F. Desmond

*Attorney, Agent, or Firm*—Renner, Otto, Boisselle & Sklar

[57] ABSTRACT

A card edge connector (10) includes electrical contacts (15) for engaging traces of a printed circuit card to establish electrical connection therewith, a housing (16) for supporting the contacts, a strain relief (17) directly molded to at least part of the contacts and housing for securing the same as an integral structure, the contacts having a compliance characteristic in the card edge connector, and a secondary compliance mechanism (95) for increasing the effective compliance characteristic of the contacts in the card edge connector. Such secondary compliance mechanism is provided by a shrinkage of some of the molded strain relief material during cooling thereof. The contacts and housing provide part of a shut of function and a shut off key (56) inserted into the housing for use during the molding provides another part of a shut off function to block flow of molding material into a contacting area of the housing (27). The invention also relates to a method for making a card edge connector and a machine for making a card edge connector.

47 Claims, 4 Drawing Sheets

INTEGRALLY MOLDED CARD EDGE CABLE TERMINATION ASSEMBLY, CONTACT, MACHINE AND METHOD

TECHNICAL FIELD

The present invention relates generally, as indicated, to card edge electrical interconnection devices and methods and, more particularly, to such devices and methods using integral molding. The invention is particularly suited to the field of mass termination connectors.

CROSS REFERENCE TO RELATED APPLICATIONS

Reference is made to the following commonly assigned U.S. patent application Ser. No. 900,909, for INTEGRALLY MOLDED CABLE TERMINATION ASSEMBLY, CONTACT AND METHOD; Ser. No. 901,762 for IMPROVED JUMPER CONNECTOR; and Ser. No. 901,763 for POLARIZING KEY FOR CARD EDGE CONNECTORS. All the applications were filed Aug. 28, 1986, and the entire disclosures thereof hereby are incorporated by reference.

BACKGROUND

In the art of electrical connectors or electrical interconnection devices for cables and the like, the term cable termination typically means a connector that is or can be used at the end or at an intermediate portion of a cable to connect the conductor or conductors thereof to an external member or members, such as another connector, cable termination, printed circuit board, or the like. Such external member usually is part of or can be connected to at least part of another electrical device, circuit, or the like; in any event, the objective is to effect electrical interconnections of respective circuits, lines, conductors, etc. A cable termination assembly is usually referred to as a combination of a cable termination with an electrical cable. Sometimes the terms cable termination and cable termination assembly equivalently are interchanged, depending on context.

The invention is described in detail below with respect to use of the principles of the invention in a multiconductor cable termination assembly. Such cable termination assembly may be used to connect the conductors of a multiconductor cable, for example, a flat ribbon multiconductor cable (or any other electrical field) to an external member, e.g., as was noted above. The actual cable termination may take the form of a card edge connector.

The discussion below relating to the preferred embodiment of the invention is directed to a multiconductor cable termination assembly. It will be appreciated, nevertheless, that the principles of the invention may be used with a cable having only a single conductor or an assemblage of cables, each having one or more conductors.

Multiconductor electrical cable termination assemblies have been available for a number of years. These cable termination assemblies, in fact, have been available in unassembled form requiring mechanical assembly thereof, which includes the mechanical clamping of the termination properly to secure the various elements of the termination and the cable, and also have been available as a permanent preassembled and molded integral structural combination. Examples of such cable termination assemblies are found in U.S. Pat. No. 3,444,506 and in U.S. Pat. No. 4,030,799, respectively.

In both such patents and the techniques disclosed therein, the junctions or connections of contacts with respective conductors of the cable are made by part of the contacts piercing through the cable insulation to engage a respective conductor. Such a connection is referred to as an insulation displacement connection (IDC).

Unfortunately, contamination of the IDC junctions, e.g., due to dirt, corrosion and the like, can detrimentally affect the junctions, e.g., causing a high impedance, an open circuit or the like. The mechanically assembled types of prior cable terminations are particularly susceptible to such consquences. The directly molded cable termination assemblies are less susceptible to contamination because of a molded hermetic seal or near hermetic seal surrounding the junctions of the cable conductors and contacts. Examples of such directly molded cable termination assemblies are presented in U.S. Pat. No. 4,030,799 and in commonly assigned, U.S. patent application Ser. No. 901,762, filed Aug. 28, 1986, for "Improved Jumper Connector", the disclosures of which are hereby incorporated in their entireties.

Card edge connectors are used to connect the conductors of a cable to terminal pads, conductive traces, etc., that are formed on a printed circuit board or card (printed circuit board and card may be used interchangeably herein). A typical card edge connector includes a plurality of electrical contacts respectively connected to conductors of the cable. The contacts are located in the connector housing in paired opposed positional relation so that when a printed circuit card is inserted into the housing, the respective pairs of contacts engage and electrically connect with respective printed circuit traces or the like on opposite surfaces of the card. Adequate space is provided in the card edge connector housing to permit the card to be inserted a distance sufficient to effect the desired engagement with respective contacts.

One common aspect of both the mechanically assembled cable termination assemblies and the directly molded type is the required assembling step or steps and the separate parts fabrications. These are labor and time consuming and, thus, are relatively expensive. For example, the mechanically assembled devices require the separate molding of several parts followed by assembling thereof. Even in the directly molded device of U.S. Pat. No. 4,030,799, to make a socket connector illustrated therein it is necessary to provide a separately molded cover, to install it over the contacts, and then to secure it, e.g., by ultrasonic welding, to the molded base. It would, of course, be desirable to minimize such mechanical assembly and welding steps and attendant costs. Such elimination of the welding is most desirable because the weld is an area of low strength, and to help assure success of a weld it often is necessary to make the parts of the connector of relatively expensive virgin plastic material.

Conventional card edge connectors may also be manufactured using mechanical assembly techniques as well as techniques that employ the merging of molding and mechanical assembly. These suffer from the same disadvantages mentioned above. Of special consideration when a card edge connector is made using the molding technique of U.S. Pat. No. 4,030,799, for example, is the separating of the opposed pairs of contacts into appropriate positions for installation with respect to the separate cover or housing so that the contacting portions of the contacts ultimately will be positioned in the desired paired opposed relation for resiliently engaging the opposite surfaces of a printed circuit card. A key or spacer has been used in the past temporarily to separate the opposed pairs of contacts while the cover is installed; thereafter, the key or spacer may be removed to permit the respective pairs of contacts resiliently to move toward each other ready for use to engage the opposite surfaces of a printed circuit card inserted into the connector.

Strength and compliance characteristics of the electrical contacts used in a card edge connector require special consideration. In particular, there should be adequate compliance so that the contacts can yield resiliently, for example, as a printed circuit card is inserted into the connector and so that the force exerted by the contacts against the surfaces of the printed circuit card are not so great as to damage the printed circuit traces thereon. This consideration tends to demand a relatively large compliance capability, especially when the actual thickness of printed circuit cards with which the card edge connector is used ordinarily is not closely controlled. The compliance capability of a contact is, in a sense, the ability of the contact to be deformed resiliently to accommodate the insertion of an external member to engagement therewith and the subsequent re-assumption of the original shape, e.g., the undeformed one, when the external member is removed from engaement with the contact. Consistent with such characteristics of compliance, another characteristic is the ability of the contact to undergo such deformation over a relatively wide range without substantial change in the original structure and various force, spring constant, and like characteristics.

Often contrasting with compliance considerations, it is desirable that the contacts be relatively strong to tolerate rough handling, insertion of an incorrectly aligned printed circuit board into the connector, etc. However, the increasing of contact strength often results in the reducing of compliance or, in any event, the increasing of the force with which the contact will press against the surface of a printed circuit card, which, as was mentioned above, should not be so excessive as to damage the traces on the printed circuit card.

One type of female contact, the fork contact, is disclosed in U.S. Pat. No. 4,030,799. A molding method disclosed in such patent is that which sometimes is referred to as insert molding. For such insert molding method, electrical contacts are placed in a mold, a multiconductor cable is placed relative to the contacts and mold, the mold is closed to effect IDC connections of the cable conductors and contacts and to close the mold cavity, and the molding material then is injected into the mold. The fork contacts mentioned are generally planar contacts in that the major extent thereof is in two directions or dimensions (height and width), and the thickness is relatively small; this characteristic makes the fork contacts particularly useful for insert molding.

BRIEF SUMMARY OF THE INVENTION

The present invention enables and represents the merging of advantages, features and components of the insert molding techniques, cable terminations and assemblies with advantages, features and components of the mechanically assembled terminations and assemblies, especially in card edge connectors.

In accordance with the present invention, a card edge connector multiconductor cable termination assembly includes junctions between the cable termination contacts and the cable conductors, a housing cover or cap (sometimes referred to as a support body) in which the contacts at least preliminarily are supported, and a strain relief body directly molded to at least part of the cable, contacts, junctions thereof, and cover. Preferably, the junctions are IDC junctions.

Such merging, at least in part, is possible by using a cooperative relation between the contacts, the cover or cap of the cable termination assembly and a temporary key or spacer to shut off the open area in the front of the cover where working (contacting) portions of the contacts are located for contacting an inserted printed circuit card. This shut off function allows the strain relief body to be molded directly to the cover, contacts, junctions and cable.

The above-mentioned U.S. Patent application Ser. No. 900,909 shows a related shut-off function, and the present invention is an improvement thereof for use particularly with card edge connectors and the like which have the mentioned open area and/or the need to provide preliminary resilient contact deformation, preloading, spacing, e.g., as paired opposed contacts for card edge connectors and the like.

The junctions of such cable termination assembly are secure, the molded strain relief assuring that the contacts and cable are held in relatively fixed positions; and the junctions of the contacts and cable conductors are hermetically sealed within the strain relief body to avoid contamination that otherwise potentially could damage the conductivity or effectiveness of connection. A similar sealing technique is disclosed in the above-mentioned U.S. patent application Ser. No. 901,762. The strain relief body holds the cable, contacts, and cover securely as an integral structure providing a strong cable termination assembly.

Also in accordance with the present invention, a method for making a cable termination assembly includes the initial supporting of one or more contacts in a cover or housing, providing a spacing and/or shut-off function, effecting IDC junction connections between the contacts and respective cable conductors, and molding the strain relief directly to at least part of the cable, contacts, and cover or housing. Importantly, the contacts have a portion intended to cooperate with the cover to provide a shut-off function to block entry of molding material into at least part of the cover during the molding process and such shut-off function is complemented or completed by using a shut-off key that blocks molding material from entering the area between contacting portions of paired opposed contacts. This shut-off feature isolates the molded-in end of the contact from the working or contacting end.

According to the present invention, good contact compliance and contact strength characteristics are achieved by use of a secondary compliance contributor. The contact itself has particular compliance capability; however, such compliance capability is enhanced using the secondary compliance contributor; and, therefore, the degree of primary compliance characteristic of the contact may be reduced, thus permitting increased contact strength. The secondary compliance is achieved using the preferred contact shape, on the one hand, and the insert molding of the strain relief body, on the other hand; these cooperate to permit a degree of freedom of movement of the contact where it is, in fact, held in place. Such freedom of movement may be bending and/or sliding movement, as is described in greater detail below. Such freedom of movement, though, is achieved due to shrinking of the molding material, preferably thermoplastic molding material, of the strain relief body as the same cools.

Moreover, walls within the card edge connector limit misalignment of the edge portion of a printed circuit card to prevent over-stressing of and damage to the contacts.

The various features of the invention may be used in electrical connectors, primarily of the card edge cable termination assembly type, as well as with other electrical connectors. The features of the invention may be used to effect an interconnection of the conductor of a single conductor cable to an external member (such as a trace or pad on a printed card) or to connect plural conductors of a multiconductor cable or assemblage of cables to respective external members (such as plural traces on such a card). The detailed description below will be directed to a card edge multiconductor cable termination assembly including a flat ribbon cable having a plurality of conductors therein.

With the foregoing and following detailed description in mind, one aspect of the invention relates to a card edge electrical connector including at least one electrical contact, a support body for at least preliminarily supporting the contact, and a strain relief body directly molded to at least part of the contact and support body to form an integral structure therewith. Moreover, consistent with this aspect of the invention, another aspect includes the use of an electrical cable with the connector to form a cable termination assembly, the strain relief body being directly molded to at least part of the contacts, cable, and support body.

Other aspects include the use of a secondary compliance contributor, particularly relying on characteristics of the insert molding technique and materials of which the card edge connector is made, a shut off key used with the contacts/cap shut off mechanism to enable the integral molding and integral device hereof, and the preventing of contact over-stressing by limiting the possible misalignment of an inserted printed circuit board.

Another aspect relates to a method of making a card edge electrical connector including placing an electrical contact in the support body portion of the connector, and molding a strain relief body directly to at least part of the contact and the support body, the molding including using at least part of the contact to provide a shut off function with respect to the support body. Such shut off function preferably is accomplished by a cooperative relation of the contact and the support body. Completion of shut off is by a shut off key. Moreover, consistent with this aspect, a further aspect relates to the effecting of an IDC connection between part of the contact and an electrical cable, and the molding including molding material also about at least part of the cable, including the junctions of the contact and cable conductor.

An additional aspect relates to a card edge cable termination assembly including at least one electrical contact, a support body for at least preliminarily supporting the contact, the contact having an IDC portion, a contacting portion, and a support offset between such portions, and the support body having a land for cooperating with the support offset to support the latter during IDC connection of the IDC portion to a conductor and preferably also during molding of a strain relief body with respect to the support body, cable and contact.

Still an additional aspect relates to a method of making a card edge cable termination assembly including placing an electrical contact in the support body portion of the assembly, the contact having an IDC portion, a contacting portion, and a support offset between such portions, and supporting the support offset by part of the support body portion while effecting IDC connection of an electrical conductor and the IDC portion.

Yet an additional aspect related to card edge connectors includes the direct molding of a strain relief body to at least part of the contact, junction, and support body portion of the assembly forming an integral structure therewith and preferably also forming a hermetic seal about the junctions.

According to a further aspect of the invention, an electrical contact for a card edge connector includes a contacting portion for relatively non-permanently electrically connecting with an external member placed relatively with respect to engagement therewith, a terminal portion for relatively permanently connecting with an electrical conductor, whereby the external member and the electrical conductor can be electrically interconnected via the contact, and an offset portion between the contacting and terminal portions for joining of the same. According to further aspects, the offset portion may provide a support function to support the contact relative to a further land or the like during IDC connection to cable conductors; use of the offset to provide a shut off surface during molding of the strain relief body relative to the contact; use of the offset to distribute forces to minimize stress applied to the electrical junctions of the contact terminal portion and such electrical conductor; and use of the offset in conjunction with a secondary compliance contributor.

Another aspect relates to a molding machine for molding a card edge connector including a mold having a first mold half for supporting therein a pre-molded connector housing and a second mold half cooperative with the first mold half for at least partly defining a mold cavity, and a conveying system for conveying molding material to the mold cavity to mold a strain relief to at least part of such housing and at least one electrical contact. The housing includes a front end, a back end, an interior chamber between such ends, a support for receiving and supporting at least one electrical contact therein and having a contacting area where such electrical contact is connectable with an external member relatively inserted for engagement therewith, and the mold cavity is closed in part by at least part of such electrical contact and at least part of such housing that are cooperative to provide at least part of a shut off function to block flow of molding material into such contacting area. A shut off key is provided further to close the mold cavity, such shut off key being positionable in such housing also to block flow of molding material from entering such contacting area. A core in the first mold half is provided for supporting such shut off key during molding.

The foregoing, following and other objects, advantages and aspects of the invention will become more apparent from the following description.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but several of the various ways in which the principles of the invention may be employed.

DESCRIPTION OF THE PREFERRED EMBODIMENT

Figure 1A:
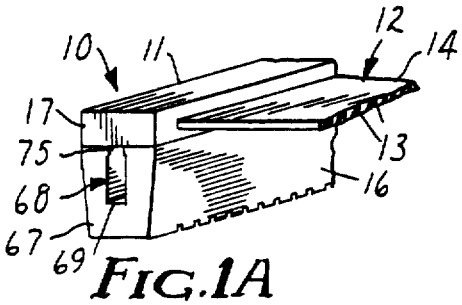
FIG. 1A is an isometric view of a card edge cable termination assembly electrical connector device in accordance with the present invention.
Figure 1B:
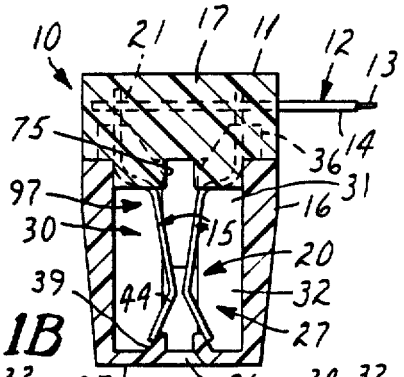
FIG. 1B is a fragmentary, end elevation view, partly in section, and partly broken away of the card edge cable termination assembly of the invention.

Referring, now, in detail, to the drawings, wherein like reference numerals designate like parts in the several figures, and initially to FIGS. 1A and 1B, a card edge cable termination assembly in accordance with the present invention is designated 10. The cable termination assembly includes a cable termination 11 and a multiconductor flat ribbon cable 12, for example, of conventional type. Such cable 12 includes a plurality of electrical conductors 13 arranged in a generally flat, spaced-apart, parallel-extending arrangement and held relative to each other by the cable insulation 14. The conductors may be copper, aluminum, or other conductive material. The insulation 14 may be polyvinyl chloride (PVC) or other material capable of providing an electrical insulation function desired. It will be appreciated that although the cable is shown as a multiconductor cable, principles of the invention may be employed with a single conductor cable. Moreover, although the multiconductor cable preferably is in the form of a flat ribbon cable, the cable configuration may be of other style, and, in fact, the multiconductor cable may be formed of a plurality of single conductor cables assembles together.

The cable termination assembly 10 is capable of effecting a mass termination function for the plurality of conductors 13 in the multiconductor cable 12.

The fundamental components of the cable termination assembly 10 include the cable termination 11 and cable 13 and the cable termination 11 includes a plurality of electrical contacts 15, a cap (sometimes referred to as a housing or cover) 16, and a strain relief 17. The cap 16 serves as a preliminary support for the contacts 15 prior to molding of the strain relief body 17. The cap 16 also provides an area 20 to receive and to guide the edge portion of a printed circuit board or the like for engagement with respective contacts 15 and to help support the electrical contacts 15 for such engagement. The electrical contacts 15 are electrically connected relatively permanently to respective conductors 13 of the cable 12 at respective insulation displacement connection (IDC) junctions 21; and the electrical contacts 15 also include a portion for relatively non-permanently connecting with another member, such as the electrically conductive traces or pads of a printed circuit card, that can be inserted to engage and can be removed from engagement with respect to the electrical contact. The strain relief body 17 is directly molded about part of the contacts 15, part of the cap 16, and the junctions 21 to form therewith an integral structure as is described further below.

Details of the cap 16 are illustrated in FIGS. 1B through 6. The cap preferably is formed by plastic injection molding techniques. The material of which the cap is made may be plastic, preferably thermoplastic, or other material that can be plastic injection molded, such material may include glass fiber material for reinforcement and/or other materials, as is well known. A preferred material for both the cap 16 and strain relief 17 is glass filled polyester. Various steps, polarizing, keying, etc., means may be provided at the outer surface or surfaces (or elsewhere) in the cap 16. Polarizing keys also may be used with the cap, e.g., as is illustrated in the above-mentioned U.S. patent application Ser. No. 901,763.

Within the cap 16 is formed the connecting area or chamber 20. Such or chamber 20 is formed in such a way as to provide desired support, positioning, aligning, and resilient pre-loading functions for the contacts 15 and to guide a printed circuit card or other external member into the chamber for making an electrical connection with the contacts 15 therein. Sidewalls bounding the chamber 20 prevent over-stessing of the contacts by limiting the relative misalignment of the printed circuit board and connector during the connecting/inserting thereof with respect to each other. At the front end 25 of the cap 16 is tapered lead-in or opening 26 providing an entrance leading into the contacting area 27 of the chamber where the printed circuit card edge can be inserted for electrical connection with respective electrical contacts 15. Such electrical connection ordinarily is non-permanent, especially relative to the permanency of the IDC junctions 21, in that in the usual case it is expected that the card edge could be withdrawn from the chamber 20.

The chamber 20 includes both the contacting area 27, a positioning area 30, and a land support area 31. The contacting area 27 is where a card edge may be inserted to engage the electrical contacts 15. The positioning area 30 helps properly to position the contacts 15 in the chamber 20 for the further steps described below in manufacturing the cable termination assembly 10, for proper orientation and separation of the contacts 15 for subsequent use of the cable termination assembly 10, and for preventing the over-stressing mentioned above. The land support area 31 provides a contact support function described in greater detail below.

Continuing to refer to FIGS. 1B–6, the positioning area 30 includes a pair of walls 32 between which is defined a space 33 within which a portion of a respective contact extends. The walls 32 provide separation of contacts that are located in adjacent spaces 33. Moreover, adjacent each respective space 33, the walls 32 bounding the same have a ledge 34 against which a portion of the contact 15 may rest for support thereby and against which such portion of the contact may, in effect, provide a shut-off function to prevent molding material of the strain relief 17 from entering the contacting area 27 of the cap 16 during molding of the strain relief body. A small step 35 at the termination of each ledge 34 provides a stop surface to limit maximum insertion of the contact 15 into the cap 16, as is described further below.

Each wall 32 also includes an upstanding tab 36 that separates the IDC ends of the contacts 15 and also provide surfaces with which the molded strain relief 17 can knit securely during molding of the strain relief body.

A slot 37 in one side of each tab 36 proximate the back wall 38 of the cap 16, i.e., relatively remote from the contacting area 27, provides further stabilizing, securement and positioning guidance for the contacts 15, and, particularly, the IDC portions thereof. A side wall of a tab 36 opposite each slot urges part of a contact into the slot further contributing to the stabilizing function.

Behind the lead-in 26 at the front end 25 of the cap 16 are a pair of walls 39 (FIG. 5) which protect the leading ends of the contacts 15 from damage by an inserted printed circuit card or the like as the latter is inserted into the chamber 20, and the walls 39 also provide a free-load force against the contacts resiliently urging them slightly away from each other for electrical isolation thereof and the circuits to which they are connected, for example, via the conductors 13 in the cable 12. Moreover, edges 32*a* of the walls 32 facing each other and facing into the chamber 20 particularly at the contacting area 27 guide the edge portion of a printed circuit board into the chamber 20 for engaging the contacts 15 while limiting misalignment of the board relative to the conductor 10.

An advantage to the cap 16 of the present invention and to the overall cable termination assembly 10 is that although the cap 16 is a relatively complex part that requires a relatively complex mold in order to effect plastic injection molding thereof, such molding of a complex part is relatively inexpensive and efficient after the mold has been made because only plastic is molded. Complex insert molding in a complex cap is unnecessary. The contacts 15 themselves are not molded as part of the cap 16. Moreover, since the cap 16 is formed with relatively complex surfaces, the contacts 15 may be relatively uncomplicated, and this further reduces cost of the cable termination assembly 10.

As will be more apparent from the description herein, the cap 16 provides a number of functions in accordance with the present invention. For example, the cap, which also may be considered a cover or a housing, covers or houses part of each of the contacts 15. The cap 16 also provides a positioning function cooperating with the contacts 15 to assure proper positioning thereof both for purposes of manufacturing the cable termination assembly 10 and for use thereof. In connection with the method for making the cable termination assembly 10, the cap 16 temporarily provides a support function serving as a support body for the contacts both during the insulation displacement connection step at which time the junctions 21 are formed and during the molding of the strain relief body 17. The cap 16, e.g. lead in 26 and wall edges 32*a*, also provides guidance for external members, such as a printed circuit card, which is inserted into chamber 20 and cooperates to avoid over-stressing of electrical contacts 15. Furthermore, since part of the contacts directly engage surfaces in the cap 16, such as within the positioning area 30 and at the ledges 34, and since part of the contacts engage the molded strain relief 17, as is illustrated and described herein, forces applied to the contacts are relatively well distributed or spread out in the cap and strain relief. Such forces may be imposed by the insertion of withdrawal of a printed circuit card relative to chamber 20 and contacts 15 therein; and such force distribution helps to minimize any damaging impact of the force on the contacts 15 themselves and/or on the junctions 21 thereof.

Figure 7:
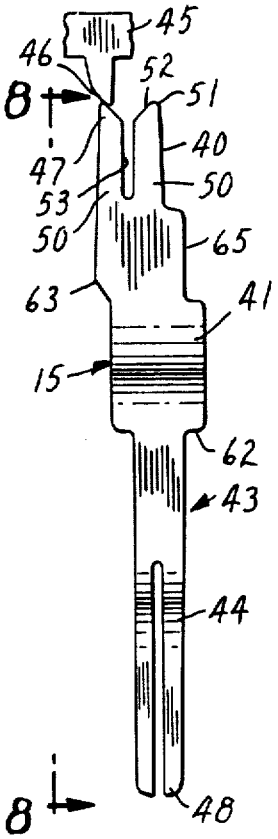
FIG. 7 is a side elevation view of the contact used in the card edge connector of the invention.
Figure 8:
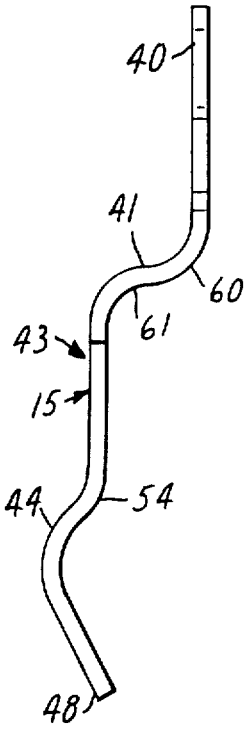
FIG. 8 is an edge/end elevation view of the contact looking generally in the direction of the arrows 8—8 of FIG. 7.
Figure 6:
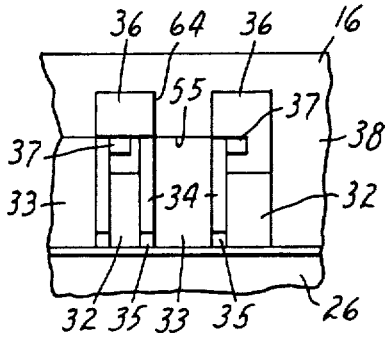
FIG. 6 is a fragmentary view enlarged showing part of the back of the cover, as in FIG. 4.

Referring to FIGS. 1B, 7 and 8, the electrical contact 15 is illustrated in detail. Preferably, each of the electrical contacts 15 is the same.

Electrical contact 15 includes an IDC terminal portion 40, a base 41, a cantilever support 43, and a contacting portion 44. The contact 15, and other identical contacts, may be die cut from a strip of material, and such contacts may be carried by a carrier strip 45 (shown only in FIG. 5) attached at a frangible connection 46 to the contacts in a manner that is well known. The carrier strip 45 is connected to the back end 47 of the contacts proximate the IDC terminal portion 40. The cantilever support 43 extends from the base 41 toward the front end 48 of the contact 15, and the contacting portion 44 supported by the cantilever support is at the front end. The cantilever support 43 extends at a small angle, e.g., several degrees, relative to a straight line drawn along the IDC portion 40 and general axial extent of the contact; such angle helps assure that the wall 29 will apply a preload force to the contacts for uniform alignment of the contacting portions 44 thereof in the chamber 20. The contacting portion 44 may be bifurcated, as is seen in FIG. 7 to help assure good connection with the surface of a printed circuit trace. The two parts of the contacting portion may slide independently on and bend with respect to the surface of such trace so preferably each trace will have at least two points of connection with the contact 15. The leading end 49 of the contact 15 is the retained part that is positioned behind the cap wall 39 for protection and to provide the contact positioning and/or resilient preload of the contacts. The contact 15 may be die cut or otherwise cut from strip material, such as berylium copper material, and the various bends and curves in the contact may be formed by stamping the same using generally conventional techniques.

At the back end 47 of the contact 15, the IDC terminal portion 40 may be of relatively conventional design intended to connect with a member, such as the conductor 13 of cable 12. Such portion 40 includes, for example, a pair of generally parallel legs 50 having pointed tips 51 and sloped surfaces 52 leading to a groove 53 between the legs. The pointed tips 51 may be used to facilitate penetrating the insulation of a cable, and the sloped surfaces 52 guide the cable conductor into the groove 53 for engagement with legs 50 to form an electrical junction 21 therewith.

The base 41 is relatively wider than the IDC terminal portion 40 and has several functions. One of those functions is the joining of the IDC terminal portion 40 and the working end 54 of the contact. The working end 54 includes the cantilever support 43 and contacting portion 44. A further function is to support the contact on the ledges 34. Another very important function of the base 41 is to cooperate with the ledges 34 and an interior wall 55 of the cap 16 to shut off the forward portion of the chamber 20 blocking the flow of plastic into the latter during the molding of the strain relief body 17. Accordingly, such base provides a shut off or at least part of such function for the cap 16 at the chamber 20 to prevent the molded strain relief material from interfering with the working end 54 of the contact. The other part of such shut-off function is provided by a shut-off key 56 insertable into an opening 58 in the cap 16, as is described further below.

The IDC terminal portion 40 is offset relative to the contacting portion 44, as is seen in FIG. 7, for example. Such offset relation facilitates relatively closely packing the contacts 15 and use thereof with relatively close-packed or closely positioned conductors 13 in a dual-in-line cable termination assembly arrangement, as is described, for example, in the above-mentioned U.S. Pat. No. 4,030,799 patent. Thus, for example, with the contacts 15 that are adjacent to each other but are in opposite rows of the dual-in-line arrangement thereof, the IDC terminal portion 40 of one of those contacts would form an electrical junction 21 with one of the conductors 13, and the other of the two contacts illustrated in the cable termination assembly 10 of FIG. 1B would form a junction 21 with a conductor that is immediately adjacent to the previously-mentioned conductor 13; and so on.

Figure 9:
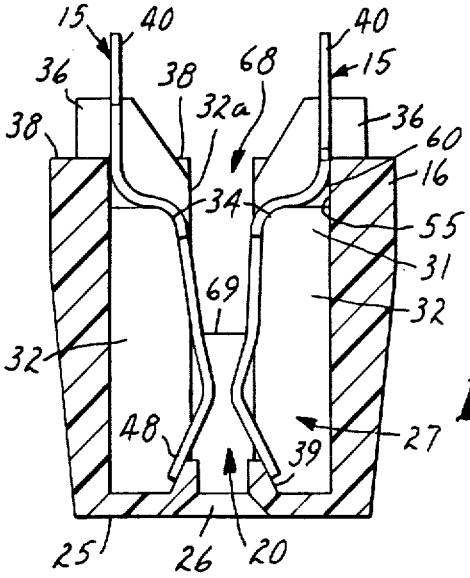
FIG. 9 is a fragmentary, end elevation view, partly in section, and partly broken away to show the contacts positioned in the connector cover.

A sub-assembly of electrical contacts 15 and the cap 16 prior to molding of the strain relief body 17 thereto is illustrated in FIG. 9. To assemble such sub-assembly the contacts 15 are inserted into respective back end 38 of cap 16 between walls 32. Such insertion may be facilitated by allowing the plurality of contacts 15 to remain fastened to the carrier strip 45 so that an entire row of contacts may be inserted after which the carrier strip 45 may be broken away at the frangible connection 46 and discarded.

Figure 4:
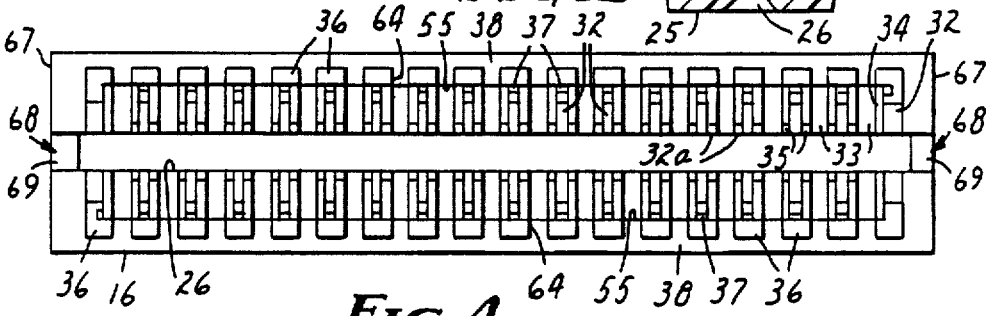
FIGS. 3 and 4 are, respectively, front and back views of the cover of FIG. 2 looking generally in the direction of the respective arrows shown therein.
Figure 2:
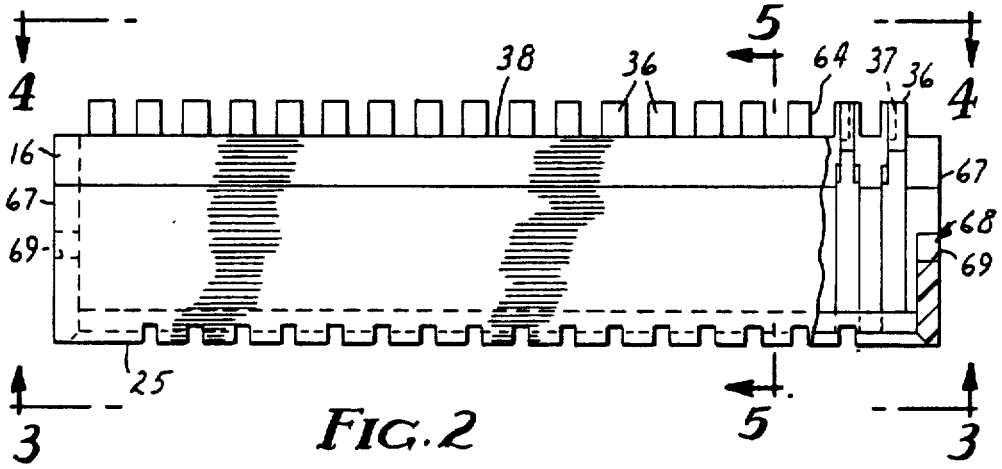
FIG. 2 is a side elevation view, partly broken away and partly in section, of the cover for the card edge connector of FIG. 1.
Figure 3:
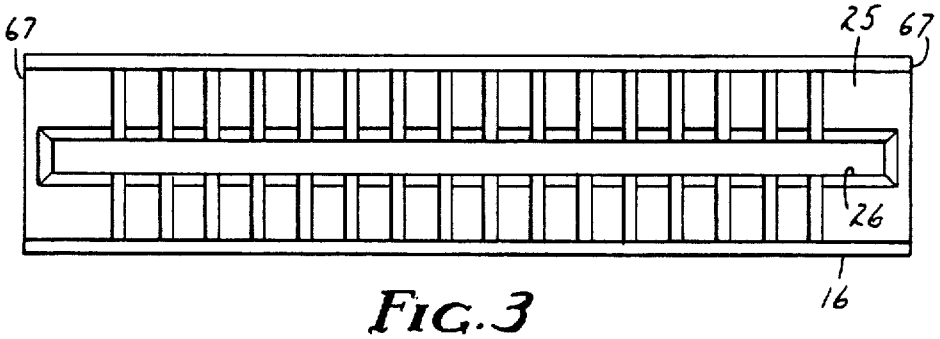
Figure 5:
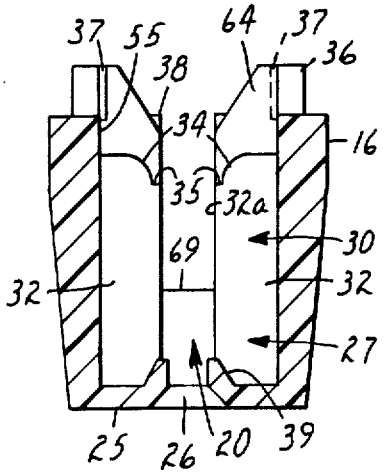
FIG. 5 is an end view in section of the cover looking generally in the direction of the arrows 5—5 of FIG. 2.

To insert a contact 15 into chamber 20, the cantilever support 43 is aligned with the opening or space 33 at the back of the cap 16 and the contacting portion 44 is aligned to slide into the contacting area 27. The offset arrangement of the IDC portion helps to assure that the spacing of the IDC terminal portions 40 of the contacts in one of the two parallel rows thereof are relatively far from the IDC terminal portions 40 of the contacts in the other row, as is seen in FIGS. 4 and 20, for example. This arrangement helps to assure maximum integrity of the insulation 14 of the cable 12 and proper connections of the contacts 15 to respective conductors 13 of the cable 12. Such spacing also helps to assure flow of plastic molding material with respect to the cable 12, contacts 15, and cap 16 to achieve secure integral connection of such parts and encapsulation and hermetic sealing of the junctions 21.

Further insertion of the contact 15 into the chamber 20 will place the front end 48 in engagement with and behind the protective wall 39, as is seen in FIG. 9. Importantly, upon full or substantially full insertion of the contact 15 with respect to the chamber 20 places surface 60 of the contact in direct confronting engagement with the cap wall 55 surface of the support land 31. A bend 61 in the contact 15 at the base 41 thereof cooperates with ledges 34 fitting closely therewith to provide the above shut-off function. Steps or surfaces 62 in the contact base 41 cooperate with the molded steps 35 in the cap 16 to limit contact insertion. Extended edge wall 63 at the offset IDC portion 41 fits in the molded slot 37 to help hold the contact in place during and after the IDC and strain relief molding processes, as the wall 64 of tab 36 against which the contact edge wall 65 bears also helps to hold the contact in place. To complete the shut-off function described above, reference is made to the illustration of FIG. 10 in which a shut-off key 56 is shown. The shut-off key may be a metal bar, for example, that is placed in the cap 16 temporarily during the molding of the strain relief body 17. The end walls 67 of the cap have slot-like openings 68 in them to permit the shut-off key 56 to be removed after molding has taken place. To facilitate such removal, the forward end (bottom as seen in FIGS. 1A and 1B) of the opening slot 68 has a flat or straight wall 69 helping to assure centering of the shut-off key 56 and the sliding removal thereof through the opening 68 in the cap wall 67.

Importantly, the shut-off key 56 has walls 70 which engage directly with corresponding edges **32*a* of the walls 32 in the cap 16 for alignment and insertion guidance of the key and to help assure proper positioning for achieving the desired shutting off of plastic flow into the contacting area 27, for example, of the chamber 20 where a circuit card would be expected to be placed. Furthermore, the back stepped portion 71 of the key 56 where the forward relatively thicker part ends preferably is approximately at the same level as the steps 35 of the termination of the ledges 34 to force the corresponding portions of the contacts 15 into engagement with the ledges for shut-off function. The back end portion 72 of the shut-off key 56 is thinner than the forward end, say by about 0.010 inch. Plastic forming the strain relief 17 can flow past the back end 73 of the shut-off key 56 into the space 74 to define a narrower area 75 at the back end of chamber 20 than is at the front end thereof. Such narrower area or space 74 is provided to fit closely to the edge of a printed circuit card inserted into the chamber 20 to prevent wobble or other movement of the card and the connector 10** when the two are connected.

Accordingly, it will be appreciated that the shut-off key 56 cooperates with the contacts 15 and with the walls 32 to prevent the flow of molding material, e.g., plastic, into the chamber 20, and more particularly into the contacting area 27, during molding of the strain relief body 17. Although the shut-off key 56 may urge the contacts 15 of one row away from those in the other, after removal of the key 56 through the opening 68, for example, the contacts will be free to deform resiliently toward each other limited by the engagement of the leading ends thereof with the walls 39 of the cap 16.

Figure 10:
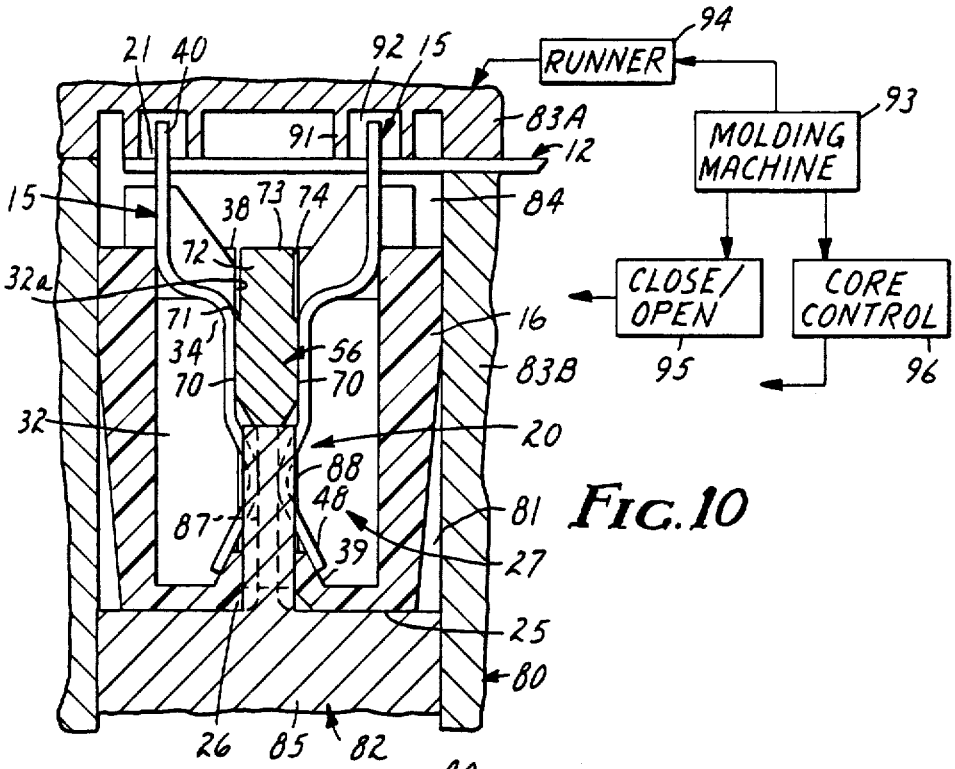
FIG. 10 is a schematic end elevation view of the cover, contacts and cable positioned in the mold of a plastic injection molding machine for molding the strain relief of the card edge cable termination assembly.
Figure 11:
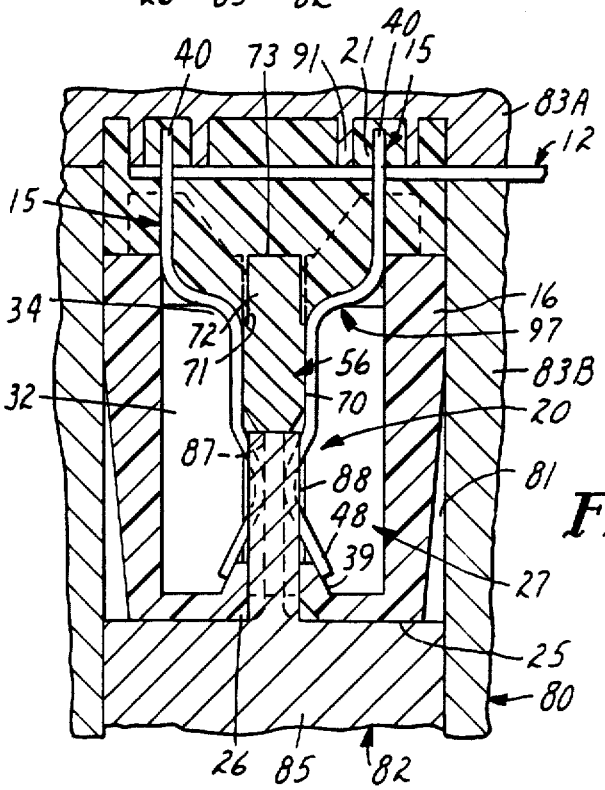
FIG. 11 is a view similar to FIG. 10 but with the molded strain relief material illustrated.

Referring to FIG. 10, a mold 80 of a molding machine is shown. The mold 80 includes a mold cavity 81 to receive the cap 16 therein. Such cap 16 preferably includes a taper or slope in the outer wall that facilitates removal of the cap from the mold cavity 81 after the molding process. The walls of the cavity 81 are not tapered or sloped as the cap 16. Associated with the mold 80 is a movable core 82. The core 82 provides support for the front end 25 of the cap 16, positioning of the contacts 15, and support for the shut-off key 56. Such support for the cap 16 by the core 82 also provides secure holding of the cap 16 in fixed position in cavity 81 even though the sloped cap walls do not closely engage the cavity walls, as is seen in FIGS. 10 and 11. Such support for the shut-off key 56 prevents the same from being urged strongly into engagement with the walls 69 in the end 68 of the cap 16 under the influence of pressure of the molding material during molding of the strain relief body 17. The mold 80 includes a top portion 83-A, the A half, which is movable relative to the lower B half 83-B. The A half 83-A provides force against the cable 12 to effect the IDC function and seals the top end of the mold cavity area 84 where the strain relief body 17 is to be molded in place.

In using the mold 80 to make the card edge cable termination assembly 10 of the invention, the top part 83-A of the mold 80 is moved out of the way. The core 82 is placed at an appropriate height in the mold cavity 81 to assure proper positioning of the cap 16 in the mold cavity 81. The contacts 15 may be inserted into the cap before or after the cap has been inserted into the cavity 81 and onto the core 82 such that the contacts are positioned approximately in the manner illustrated in FIG. 10. The upper or back portion of the cap 16 is configured to fit close to the cavity walls to prevent plastic from flowing past the cap into the bottom portion of the cavity 81 where the cap walls are sloped. The shut-off key 56 is placed in the cap from the back end 38 thereof generally to the position that is illustrated in FIG. 10. The ends of the shut-off key 56 extend to the outside surfaces of the end walls of the cap 16 to prevent plastic from filling the openings 68.

Figure 12:
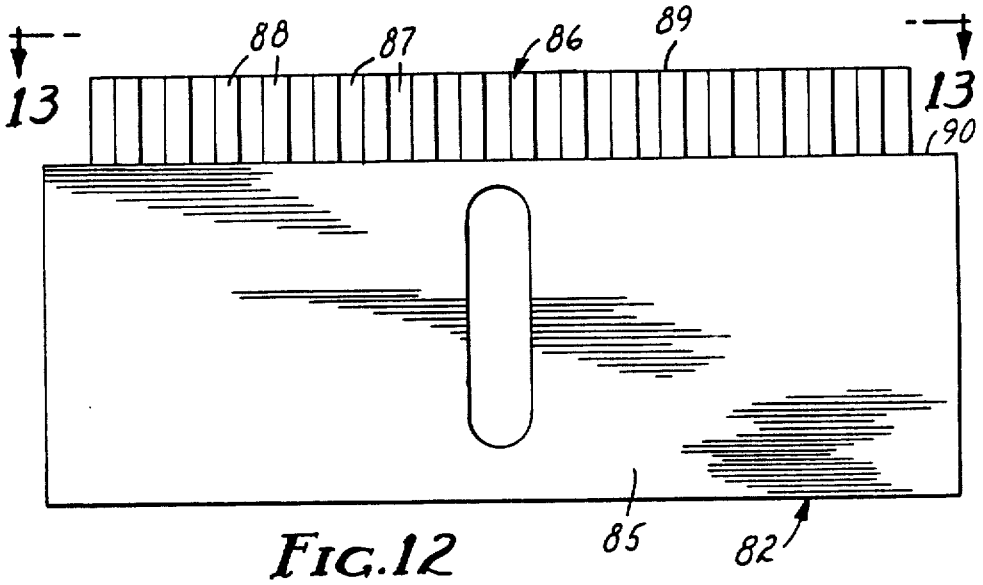
FIGS. 12 and 13 are, respectively, side elevation and top plan views of a movable core used in the mold of FIGS. 10 and 11.
Figure 13:
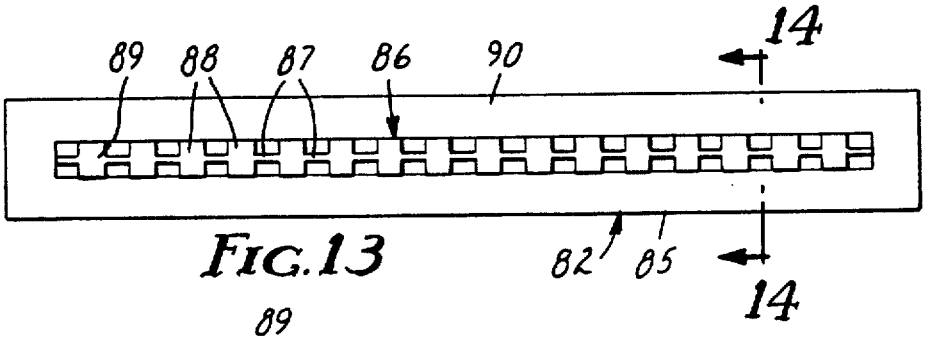
Figure 14:
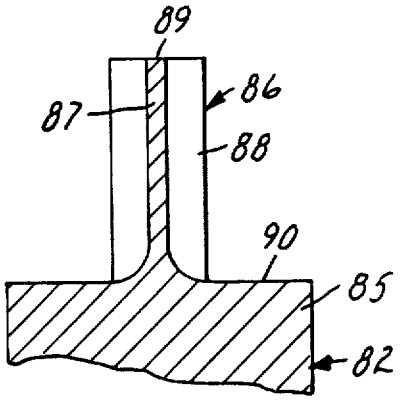
FIG. 14 is an enlarged section view of the core looking generally in the direction of the arrows 14—14 of FIG. 13.

Briefly referring to FIGS. 12, 13 and 14, the core 82 is shown in detail. The core 82 includes a main support 85, which preferably fits closely with corresponding walls of the mold 80 B half 83-B and is slidable between those walls. At the top end of the core 82 is a divider support 86. The divider support 86 includes a plurality of relatively narrow or thin walls 87 and a plurality of relatively thicker walls 88. The thicker walls 88 preferably are approximately the same thickness as the size of the opening 26 at the front 25 of the cap 16 to provide maximum stabilizing support of the cap with minimum lateral movement thereof and for stength so the divider support 86 is not crushed under pressure in the molding operation. The top surface 89 of the divider support 86 engages the bottom of the shut-off key 56 and supports the latter during molding, for example, so that such key will not too forcefully press against the walls 69. Moreover, the surface 90 of the core 82 preferably supports the front end 25 of the cap 16 during the process of molding the strain relief 17. The thickness of the thinner walls 87 is adequate to fit between respective pairs of opposed contacts 15 in the cap 16 in the manner illustrated, for example, in FIG. 10. The walls 87 and 88 cooperate with the contacts 15 to help hold the contacts in place during the molding process so that the contacts will be properly aligned in the connector 10 after completion of the manufacturing thereof.

After the contacts 15, cap 16, and shut-off key 56 are placed in the manner illustrated in FIG. 10, the cable 12 may be placed in alignment with the respective IDC portions 20 of the contacts. Thereafter, the top part 83-A of the mold 80 may be closed to seal against the bottom part 83-B and to push the cable 12 toward the IDC portions 40 of the contacts to form the junctions 21 in the manner described in the above application.

The walls 91 in the top mold part 83-A specifically urge the cable 12 toward the IDC portions of the contacts. Space 92 between the walls 91 provides an area for molding material to flow so as substantially fully to encapsulate the junctions 21, as is shown, for example, in FIG. 11 and is described in the '763 application.

Schematically shown in FIG. 10 is a molding machine 93 with which the mold 80 is associated. Machine 93 may be a conventional plastic injection molding machine modified to include the operative mold 80 with core 82. Machine 93 also would include, for example, a runner system 94 to distribute molding material to mold cavity 81, conventional open/close means 95 to open and to close the mold, and a core control 96 to move the core 82. Core control 96 may include various pins, mechanical connections, hydraulic connections, etc., as is well known, to effect core positioning and movement, say relative to the mold half 83-B.

Referring to FIG. 11 in particular, the illustration is similar to that of FIG. 10 except that the molded strain relief body 17 is shown molded in place. After conclusion of such molding process, the top mold part 83-A can be moved upward to operate the mold while the cable termination assembly 10 remains in the bottom mold part 83-B. Thereafter, the core 82 may be slid upward in the mold cavity 81 to urge the entire cable termination assembly 10 out from the mold cavity 81 as an ejector bar. The cable termination assembly 10 may be removed from the core 81, then, and the shut-off key 56 may be slid out from the cap 16 through opening 68 in the one of the end walls 67.

According to the preferred embodiment, the material of which the strain relief body 17 is molded and that of which the cable insulation 14 is formed are compatible so that the two chemically bond during the molding step described. Also, preferably the material of which the strain relief body 17 is molded and that of which the cap 16 is made are the same or are compatible to achieve chemical bonding thereof during such molding step described. Further, the temperature at which molding occurs preferably is adequately high to purge or otherwise to eliminate oxygen and moisture from the areas of the junctions 21. Such oxygen-free and moisture-free environment preferably is maintained by a hermetic seal of the junctions 21 achieved by the encapsulation thereof in the strain relief body 17 and helps to prevent electrolytic action at the junctions; therefore, interaction or reaction of the materials os which the conductors 13 and contacts 15 are made, even if different, will be eliminated or at least minimized.

It will be appreciated that the above-described method of making the cable termination assembly 10 effects facile mass termination of the conductors of a multiconductor cable. Since the strain relief body 17 is molded directly to the cap 16, there is no need separately to fasten a cap to a molded strain relief body, e.g., by ultrasonic welding, or the like, as is described in the U.S. Pat. No. 4,030,799 patent. Furthermore, since there is no need to effect a separate ultrasonic welding function, relatively less expensive materials, such as re-grind or those including re-grind materials, can be used to make the cap 16 and strain relief body 17, thus reducing the cost for the cable termination assembly 10.

In using the cable termination assembly 10 of the invention, the edge of a printed circuit card may be inserted into the opening 26 of chamber 20. During such insertion the contacting portions 44 of contacts 15 are pushed slightly out of the way permitting further insertion. The contacting portions wipe against the traces on the card to form good electrical connections therewith.

The secondary compliance part and function of the invention is designated 97 and is a result of the relationship of the molded material of the strain relief body 17 to the pre-molded cap 16 and the contacts 15. More specifically, after the material of which the strain relief body is molded cools, such material ordinarily will tend to undergo some shrinkage. Such shrinkage will tend to cause such material slightly to free up the contacts at the area of the ledges 34 in particular to permit limited sliding and/or bending of the contacts in that area. Nevertheless, such material of which the strain relief body 17 is molded preferably will tend to knit relatively securely to those portions of the cap 16 to which it is directly engaged during molding in order to form a very strong interconnection therewith and still relatively securely to hold the contacts 15 in place.

In view of such secondary compliance capability of the invention, the invention may employ contacts 15 that are relatively stiffer and stronger than those that otherwise might be required in a card edge connector to achieve adequate compliance characteristics. Such added strength of the contacts provides improved longevity for the card edge connector 10 without reducing the overall compliance characteristics thereof.

While the invention is illustrated and described above with reference to multiconductor electrical cable termination 11 located at an end of the multiconductor electrical conductor 12, it will be apparent that such a termination also may be provided in accordance with the invention at a location on a multiconductor electrical cable intermediate the ends thereof.

Although the invention has been shown and described with respect to a particular preferred embodiment, it is obvious that equivalent alterations and modifications will occur to others skilled in the art upon the reading and understanding of this specification.

The present invention includes all equivalent alterations and modifications, and is limited only by the scope of the following claims.

STATEMENT OF INDUSTRIAL APPLICATION

With the foregoing in mind, it will be appreciated that the card edge cable termination assembly and method described in detail above and illustrated in the drawings may be used to effect electrical interconnections in the electrical and electronics arts.

The embodiments of the invention in which an exclusive property or privilege is claimed are, as follows:

1. A card edge connector, comprising:

at least one electrical contact having contacting means for engaging with a printed circuit card to establish electrical connection with conductive means thereon, support means for supporting said contacting means, and a connecting means for connecting said electrical contact with another conductive member;

housing means for supporting said electrical contact with respect thereto; and strain relief means directly molded to at least part of said electrical contact and said housing means for securing the same as an integral structure;

said electrical contact having a compliance characteristic in the card edge connector; and said strain relief means including therein secondary compliance means spaced from a part of said support means of said contact for permitting limited movement of said part of said support means within a region of confinement formed between said housing and said strain relief means to increase the effective compliance characteristic of said electrical contact in the card edge connector.

2. The connector of claim 1, said housing means further comprising stabilizing means for stabilizing said electrical contacts during molding of said strain relief means.

3. The connector of claim 1, wherein said at least one electrical contact comprises a plurality of electrical contacts arranged in a pair of parallel rows in paired wiping relation to wipe against surfaces of a printed circuit card inserted into the connector, and wherein said housing means includes entrance means for receiving a portion of a printed circuit card for connection with respective electrical contacts.

4. A cable termination assembly, comprising the connector of claim 3, and further comprising a multiconductor electrical cable, said connecting means of respective electrical contacts connecting with respective conductors of said cable and forming electrical junctions therebetween, and wherein said strain relief means is directly molded to at least part of said cable, electrical contacts, junctions, and housing means.

5. A cable termination assembly, comprising the connector of claim 1, and further comprising an electrical cable having at least one conductor, said connecting means of said at least one electrical contact and said at least one conductor of said cable forming an electrical junction therebetween, and wherein said strain relief means is directly molded to at least part of said cable, at least one electrical contact, junction, and housing means.

6. The assembly of claim 5, said at least one electrical contact comprising plural electrical contacts, said electrical cable comprising a multiconductor electrical cable, said contacts forming respective junctions with respective conductors of said electrical cable, and wherein said strain relief means is directly molded to at least part of said cable, electrical contacts, junctions, and housing means to form an integral structure thereof.

7. The assembly of claim 6, wherein said strain relief means is molded to form a substantially hermetic seal about said junctions.

8. A card edge connector, comprising:

at least one electrical contact having contacting means for engaging with a printed circuit card to establish electrical connection with conductive means thereon, support means for supporting said contacting means, and a connecting means for connecting said electrical contact with another conductive member;

housing means for supporting said electrical contact with respect thereto; and strain relief means directly molded to at least part of said electrical contact and said housing means for securing the same as an integral structure;

said electrical contact having a compliance characteristic in the card edge connector;

said connector further comprising secondary compliance means for increasing the effective compliance characteristic of said electrical contact in the card edge connector; and said secondary compliance means comprising a portion of said strain relief means that undergoes shrinkage after molding of said strain relief means.

9. A card edge connector, comprising:

at least one electrical contact having contacting means for engaging with a printed circuit card to establish electrical connection with conductive means thereon, support means for supporting said contacting means, and a connecting means for connecting said electrical contact with another conductive member;

housing means for supporting said electrical contact with respect thereto; and strain relief means directly molded to at least part of said electrical contact and said housing means for securing the same as an integral structure;

said electrical contact having a compliance characteristic in the card edge connector;

said connector further comprising secondary compliance means for increasing the effective compliance characteristic of said electrical contact in the card edge connector;

said strain relief means being formed of a material that undergoes shrinkage upon cooling after molding; and said secondary compliance means comprising a portion of said strain relief means that has cooled and shrunk at an area thereof partly away from part of said electrical contact to facilitate limited sliding and/or bending of the electrical contact at such area.

10. A card edge connector, comprising:

at least one electrical contact having contacting means for engaging with a printed circuit card to establish electrical connection with conductive means thereon, support means for supporting said contacting means, and a connecting means for connection said electrical contact with another conductive member;

housing means for supporting said electrical contact with respect thereto; and strain relief means directly molded to at least part of said electrical contact and said housing means for securing the same as an integral structure;

said electrical contact having a compliance characteristic in the card edge connector;

said connector further comprising secondary compliance means for increasing the effective compliance characteristic of said electrical contact in the card edge connector;

said support means including a bend area in said electrical contact between said contacting means and said connection means;

said housing means including ledge means for cooperating with at least part of said bend area to support said electrical contact with respect to said housing means, and said secondary compliance means comprising at least part of said strain relief means that generally holds said electrical contact in place in the area of said ledge means with some freedom to bend and/or to slide during deflection of at least part of said electrical contact.

11. The connector of claim 10, said ledge means terminating in a stop and said bend area including surface means for cooperating with said step to limit insertion of distance of said electrical contact into said housing means.

12. A card edge connector, comprising:

plural electrical contacts each having contacting means for engaging with a printed circuit card to establish electrical connection with conductive means thereon, support means for supporting said contacting means, and a connecting means for connecting said electrical contact with another conductive member;

housing means for supporting said electrical contacts with respect thereto, and strain relief means directly molded to at least part of each one of said plural electrical contacts and said housing means for securing the same as an integral structure;

said electrical contacts having a compliance characteristic in the card edge connector;

said housing means having a contacting area where contacting portions of said electrical contacts are positioned to make electrical connections with respective conductive means of a printed circuit card; and said electrical contacts and housing means having respective cooperative surface means for cooperating with each other for at least partly shutting off said contacting area to prevent molding material of said strain relief means from entering said contacting area during molding thereof.

13. The connector of claim 12, said housing means further comprising opening means for receiving and temporarily containing shut off key means for completing the shutting off of said contacting area.

14. A card edge connector, comprising:

at least one electrical contact having contacting means for engaging with a printed circuit card to establish electrical connection with conductive means thereon, support means for supporting said contacting means, and a connecting means for connecting said electrical contact with another conductive member;

housing means for supporting said electrical contact with respect thereto; and strain relief means directly molded to at least part of said electrical contact and said housing means for securing the same as an integral structure;

said electrical contact having a compliance characterisitc in the card edge connector;

said connector further comprising secondary compliance means for increasing the effective compliance characteristic of said electrical contact in the card edge connector; and said housing means comprising tab means for knitting with said strain relief means during molding thereof.

15. A card edge connector, comprising:

plural electrical contacts each having contacting means for engaging with a printed circuit card to establish electrical connection with conductive means thereon, support means for supporting said contacting means, and a connecting means for connecting said electrical contact with another conductive member;

housing means for supporting said electrical contact with respect thereto; and strain relief means directly molded to at least part of each one of said plural electrical contacts and said housing means for securing the same as an integral structure;

said electrical contacts having a compliance characteristic in the card edge connector;

said connector further comprising secondary compliance means for increasing the effective compliance characterisitc of said electrical contacts in the card edge connector;

said housing means further comprising stabilizing means for stabilizing said electrical contacts during molding of said strain relief means; and said stabilizing means comprising slot means for receiving in relatively close fitting relation at least a part of respective electrical contacts and wall means opposite said slot means for urging said part of respective electrical contacts into said slot means.

16. The connector of claim 15, said housing means further comprising generally upstanding tab means for knitting with said strain relief means during molding thereof and said wall means comprising a wall of said tab means.

17. A method for making a card edge connector, comprising:

initially supporting at least one electrical contact in a housing while placing a contacting portion of such electrical contact in a contacting area of such housing, directly molding a strain relief to at least part of such electrical contact and at least part of such housing, using at least part of such electrical contact and at least part of such housing to cooperate at least partly to shut off such contacting area during said molding to block flow of molding material into such contacting area, and inserting a shut off key into such housing to cooperate with at least one of a part of such housing and a part of such electrical contact to complete shutting off of such contacting area.

18. The method of claim 17, said initially supporting comprising inserting such electrical contact into such housing.

19. The method of claim 17, said initially supporting comprising inserting a plurality of electrical contacts into at least part of such housing.

20. The method of claim 19, wherein such electrical contact has a connecting portion for connecting with an external member, and further comprising forming electrical junctions between respective connecting portions and such external member.

21. The method of claim 19, wherein such external member is a multiconductor electrical cable, and said forming comprising forming insulation displacement connection junctions between respective electrical contacts and conductors of such cable.

22. The method of claim 21, wherein said molding comprises directly molding the strain relief to at least part of such cable, electrical contacts, junctions thereof, and housing.

23. The method of claim 22, wherein such electrical contacts have a compliance characterisitc in such housing, and said molding comprising providing a secondary compliance contributor for such electrical contacts to increase the compliance characteristics thereof.

24. The method of claim 23, said providing a secondary compliance contributor comprising allowing at least some of the material molded as such strain relief to shrink during cooling thereof.

25. The method of claim 17, wherein such electrical contact has a compliance characteristic in such housing, and said molding comprising providing a secondary compliance contributor for such electrical contact to increase the compliance characteristics thereof.

26. The method of claim 25, said providing a secondary compliance contributor comprising allowing at least some of the material molded such as strain relief to shrink during cooling thereof.

27. The method of claim 17, further comprising removing such shut off key to open a contacting area of such housing to permit insertion into such contacting area of a portion of a printed circuit board for electrical connection with such electrical contact.

28. The method of claim 17, further comprising placing such housing into a mold, supporting such housing in the mold, closing such mold to define a mold cavity with at least part of such housing, and inputting molding material into such mold cavity to form such strain relief.

29. The method of claim 17, wherein each electrical contact has a connecting portion for connecting with a respective conductor of an electrical cable, and further comprising forming an insulation displacement connection junction between said electrical contact and respective conductor of such cable.

30. The method of claim 29, wherein such mold includes a movable portion and a relatively fixed portion, and said forming insulation displacement connection junctions comprising moving such movable mold portion toward such relatively fixed mold portion to close said mold cavity.

31. The method of claim 28, further comprising supporting such shut off key by a part of the mold independently of such housing during such molding.

32. A method for making a card edge connector, comprising:

initially supporting at least one electrical contact in a housing while placing a contacting portion of such electrical contact in a contacting area of such housing, directly molding a strain relief to at least part of such electrical contact and at least part of such housing, using at least part of such electrical contact and at least part of such housing to cooperate at least partly to shut off such contacting area during said molding to block flow of molding of molding material into such contacting area, and such electrical contact having a compliance characteristic in such housing, and said molding comprising permitting at least part of the molding material to shrink during cooling to provide a secondary compliance contributor for such electrical contact.

33. The method of claim 32, further comprising inserting a shut off key into such housing to cooperate with at least a part of such housing and/or at least part of such electrical contact to complete shutting off of such contacting area.

34. The method of claim 33, further comprising removing such shut off key to open a contacting area of such housing to permit insertion thereinto of a portion of a printed circuit board for electrical connection with such electrical contact.

35. The method of claim 32, said initially supporting comprising inserting a plurality of electrical contacts into at least part of such housing.

36. The method of claim 32, wherein each electrical contact has a connecting portion for connecting with a respective conductor of an electrical cable, and further comprising forming an insulation displacement connection junction between said electrical contact and respective conductor of such cable.

37. The method of claim 36, wherein said molding comprises directly molding the strain relief to at least part of such cable, electrical contacts, junctions thereof, and housing.

38. The method of claim 32, further comprising placing such housing into a mold, supporting such housing in the mold, closing such mold to define a mold cavity with at least part of such housing, and inputting molding material into such mold cavity to form such strain relief.

39. The method of claim 38, further comprising inserting a shut off key into such housing to cooperate with at least one of a part of such housing and a part of such electrical contact to complete shutting off of such contacting area.

40. The method of claim 39, wherein each electrical contact has a connecting portion for connecting with a respective conductor of an electrical cable, and further comprising forming an insulation displacement connection junction between said electrical contact and respective conductor of such cable.

41. The method of claim 40, wherein such mold includes a movable portion and a relatively fixed portion, and said forming insulation displacement connection junctions comprising moving such movable mold portion toward such relatively fixed mold portion to close the mold cavity.

42. The method of claim 39, further comprising supporting such shut off key by a part of the mold independently of such housing during such molding.

43. A molding machine for molding a card edge connector, comprising:

first mold means for supporting therein a pre-molded connector housing, such housing including a front end, a back end, an interior chamber between such ends, such housing including means for receiving and supporting at least one electrical contact therein and having a contacting area where such electrical contact is connectable with an external member relatively inserted for engagement therewith, second mold means cooperative with said first mold means for at least partly defining a mold cavity, conveying means for conveying molding material to said mold cavity to mold a strain relief to at least part of such housing and at least one electrical contact, said mold cavity being closed in part by at least part of such electrical contact and at least part of a shut off function to block flow of molding material into such contacting area, and said mold cavity further being closed in part by a shut off key positioned in such housing also to block flow of molding material from such contacting area, and core means in said first mold means for supporting such shut off key during molding.

44. The machine of claim 43, said core means further comprising ejecting means for ejecting such housing after molding of such strain relief.

45. The machine of claim 43, said core means further comprising means for supporting at least part of such housing during molding.

46. The machine of claim 43, such at least one electrical contact comprising plural electrical contacts, and said core means further comprising positioning means for determining position of such electrical contacts during molding.

47. The machine of claim 43, wherein such card edge connector is a cable termination assembly including a multiconductor electrical cable and such electrical contacts include insulation displacement portions, and further comprising means for pressing such cable and electrical contacts toward each other to form insulation displacement junctions between the same.

* * * * *

UNITED STATES PATENT AND TRADEMARK OFFICE

CERTIFICATE OF CORRECTION

PATENT NO. : 4,776,803
DATED : October 11, 1988
INVENTOR(S) : David A. Pretchel, et al It is certified that error appears in the above-indentified patent and that said Letters Patent is hereby corrected as shown below:

Column 14, Line 53, "the material os" should read --the material of --.

Column 19, Line 46, "wherein such" should read –wherein each–.

Column 22, Line 13, " part of a shut" should read --part of such housing that are cooperative to provide at least part of a shut--.

Signed and Sealed this

Fourteenth Day of March, 1995

Bruce Lehman

*Attest:*

BRUCE LEHMAN

*Attesting Officer*

*Commissioner of Patents and Trademarks*